US005560055A

United States Patent [19]

Ziegler

[11] Patent Number: 5,560,055

[45] Date of Patent: Oct. 1, 1996

[54] COLLAPSIBLE PLAYYARD

[75] Inventor: Scott Ziegler, El Cajon, Calif.

[73] Assignee: Hasbro, Inc., Pawtucket, R.I.

[21] Appl. No.: 437,631

[22] Filed: May 9, 1995

[51] Int. Cl.[6] ..... A47D 7/00

[52] U.S. Cl. ..... 5/99.1; 5/93.1

[58] Field of Search ..... 5/99.1, 93.1; 248/166, 248/440; 135/151, 152, 154, 128, 147; 108/134, 115, 167, 172; 52/79.5; 160/377

[56] References Cited

U.S. PATENT DOCUMENTS

| | | | |
|---|---|---|---|
| 1,533,636 | 4/1925 | Day | 5/99.1 |
| 2,491,036 | 12/1949 | Dodge | 5/99.1 |
| 2,561,637 | 7/1951 | Rex | 5/99.1 |
| 3,018,493 | 1/1962 | Wittbrodt | 5/99.1 |
| 3,550,601 | 12/1970 | Peters | 135/152 |
| 4,044,411 | 8/1977 | Peterson | 5/99 A |
| 4,070,716 | 1/1978 | Satt et al. | 5/99 C |
| 4,376,318 | 3/1983 | Cirillo | 5/99 C |
| 4,561,138 | 12/1985 | Hwang | 5/102 |
| 4,573,224 | 3/1986 | Saint | 5/99 C |
| 4,651,367 | 3/1987 | Osher et al. | 5/99 R |
| 4,688,280 | 8/1987 | Kohus et al | 5/99 R |
| 4,692,953 | 9/1987 | Fetters | 5/99 R |
| 4,811,437 | 3/1989 | Dillner et al. | 5/99 B |
| 4,837,875 | 6/1989 | Shamie et al. | 5/99 C |
| 4,934,025 | 6/1990 | Mariol | 16/347 |
| 4,985,948 | 1/1991 | Mariol | 5/99.1 |
| 5,197,154 | 3/1993 | Shamie | 5/99.1 |
| 5,228,154 | 7/1993 | Brevi et al. | 5/99.1 |
| 5,239,714 | 8/1993 | Huang | 5/99.1 |
| 5,243,718 | 9/1993 | Shamie | 5/99.1 |
| 5,279,006 | 1/1994 | Teng | 5/99.1 |
| 5,293,656 | 3/1994 | Chan | 5/99.1 |
| 5,353,451 | 10/1994 | Hsiung | 5/99.1 |
| 5,381,570 | 1/1995 | Cheng | 5/99.1 |
| 5,394,574 | 3/1995 | Chuang | 5/99.1 |

*Primary Examiner*—Steven N. Meyers
*Assistant Examiner*—Tuyet-Phuong Pham
*Attorney, Agent, or Firm*—Kurt R. Benson

[57] ABSTRACT

A collapsible playyard for an infant includes a frame subassembly including at least two frame members which are joined together in substantially perpendicular relation. Each of the frame members includes two frame member sections which are joined by a knuckle joint which only permits pivoting between the frame member sections thereof in a single direction. The knuckle joints are oriented so that collapsing one frame member rotates the adjacent frame member causing the knuckle joint thereof to be automatically moved to a collapsible position.

10 Claims, 8 Drawing Sheets

COLLAPSIBLE PLAYYARD

BACKGROUND AND SUMMARY OF THE INVENTION

The instant invention relates to infant playyards and more particularly to a playyard for an infant which is quickly and easily movable between a collapsed position and an erected position.

A variety of different playyards have been heretofore available and, in this regard, the playyards disclosed in the Peterson U.S. Pat. No. 4,044,411; Satt et al., No. 4,070,716; Cirillo, No. 4,376,318; Hwang, No. 4,561,138; Saint, No. 4,573,224; Osher et al., No. 4,651,367; Kohus et al., No. 4,688,280; Fetters, No. 4,692,953; Shamie et al., No. 4,837,875; Mariol, No. 4,985,948; Shamie, No. 5,197,154; Brevi et al., No. 5,228,154; Huang, No. 5,239,714; Shamie, No. 5,243,718; Teng, No. 5,279,006; Cheng, No. 5,381,570; and Chuang, No. 5,394,574, represent the closest prior art to the subject invention of which the Applicant is aware.

It has generally been found that in order to be effective, a playyard must be sufficiently rugged and durable to provide a suitable confining structure for an infant. In addition, however, it has been found that it is highly desirable for a playyard to be readily collapsible to a sufficiently reduced overall size to enable it to be easily transported. However, while the desirability of having a playyard structure which is readily and easily collapsible has generally been heretofore recognized, the prior art, particularly as exemplified by the playyard structures disclosed in the above-referenced U.S. Patents, has failed to provide a playyard which is quickly and easily collapsible with a minimum of manipulative operations. Hence, a need exists for an effective and durable playyard for an infant which is effectively adapted to be moved between collapsed and erected positions with a minimum of simple manipulative operations.

The instant invention provides a highly effective playyard and subassembly therefore which are adapted to enable the playyard to be moved between collapsed and erected positions with a minimum of manipulative operations. Specifically, the playyard of the instant invention comprises a frame subassembly comprising a plurality of collapsible frame elements which are connected so that when the subassembly is in an erected position, the frame elements essentially work against one another to prevent the subassembly from being inadvertently collapsed, but so that when one of the frame elements is manually moved to a collapsed position, at least one adjacent frame element connected thereto is automatically moved to a readily collapsible position. Still more specifically, the frame subassembly of the instant invention comprises at least two, and preferably three, collapsible frame elements which are connected in such a way so that when one of the frame elements is collapsed by pivoting a pair of frame sections thereof about a center knuckle joint, the one or more adjacent frame elements connected thereto are at least partially rotated to reorient knuckle joints therein so that they can be readily and easily collapsed. In this regard, because the frame subassembly is constructed so that certain of the frame elements thereof are reoriented to collapsible positions when other frame elements are moved to collapsed positions, the subassembly can be retained in an erected position with a minimum of locking mechanisms so that only a minimum number of unlocking operations is required to move the subassembly to a fully collapsed position.

Still more specifically, the collapsible frame subassembly of the instant invention in its most basic format comprises first and second frame members which are connected together in substantially perpendicular relation. The first and second frame members each include a pair of frame member sections which are joined by a knuckle joint, and the knuckle joints each only permit relative pivotal movement between the respective frame member sections thereof in a single direction. The directions of pivotal movement permitted by the knuckle joints of the first and second frame members are oriented at an angle of at least approximately 90 degrees when the subassembly is in an erected position. The second frame member is, however, attached to the first frame member such that relative pivoting between the second frame member sections thereof to substantially side-by-side positions causes the knuckle joint of the first frame member to be reoriented by approximately 90 degrees to permit the first frame member to be collapsed in a corresponding predetermined direction.

The collapsible subassembly preferably includes first, second and third frame members which are connected together so that they are positionable in an erected position in which the first and third frame members are disposed and spaced in substantially parallel coplanar relation and in which the first and second frame members cooperate with the second frame member to define a generally square-cornered U-shaped structure. The frame members each include a pair of frame member sections which are pivotally joined together by a knuckle joint, and the frame members are constructed so that the frame member sections thereof are in aligned relation when the frame member sections are in erected positions. The knuckle joints are adapted so that they only permit relative pivotal movement between the frame member sections thereof in a single direction from aligned relation, and the first and third frame members are oriented so that when the subassembly is in the erected position thereof, the knuckle joints of the first and third frame members only permit pivoting between the respective frame member sections thereof in directions which are angularly related by an angle of at least approximately 90 degrees. Further, the second frame member is connected to the first and third frame members such that relative pivoting between the second frame member sections to substantially parallel side-by-side positions causes sufficient angular rotation of the knuckle joint of at least one of the first and third frame members to permit relative pivoting between the frame member sections of the first and third members in substantially the same direction for collapsing the subassembly. The collapsible subassembly preferably further comprises means for releasably maintaining the second frame member in the erected position thereof, and the first and third frame members are preferably retained in the erected positions thereof by the relative positions of the knuckle joints thereof when the subassembly is in the erected position. The subassembly is preferably adapted to be included as part of the frame assembly of a collapsible playyard wherein covering means is provided on the frame assembly. Further, the covering means preferably functions to help prevent pivoting of the knuckle joint of at least one of the first and third frame members when the subassembly is in the erected position thereof, but not when the second frame member is in a collapsed position. Accordingly, the covering means on the playyard preferably cooperates with the frame subassembly for retaining the frame assembly in an erected position in a manner which nevertheless allows the frame assembly to be readily and easily collapsed.

It has been found that the instant invention provides a highly effective and readily collapsible playyard for an infant. In this regard, by utilizing frame members which essentially work against each other to retain the playyard in an erected position but which are automatically reoriented to collapsible positions as an adjacent frame member is collapsed, the playyard of the instant invention can be effectively retained in an erected position with a minimum of locking or latching elements. As a result, it can be automatically moved to a collapsed position with a minimum of unlocking or unlatching manipulations.

Accordingly, it is a primary object of the instant invention to provide an effective playyard for an infant which is adapted to be moved between erected and collapsed positions with a minimum of manipulations.

Another object of the instant invention is to provide a readily collapsible playyard assembly which is operative with a minimum of locking or latching elements for retaining it in an erected position.

An even still further object of the instant invention is to provide an effective subassembly for a playyard wherein certain frame members of the subassembly are automatically moved to collapsible positions once adjacent frame members have been collapsed.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
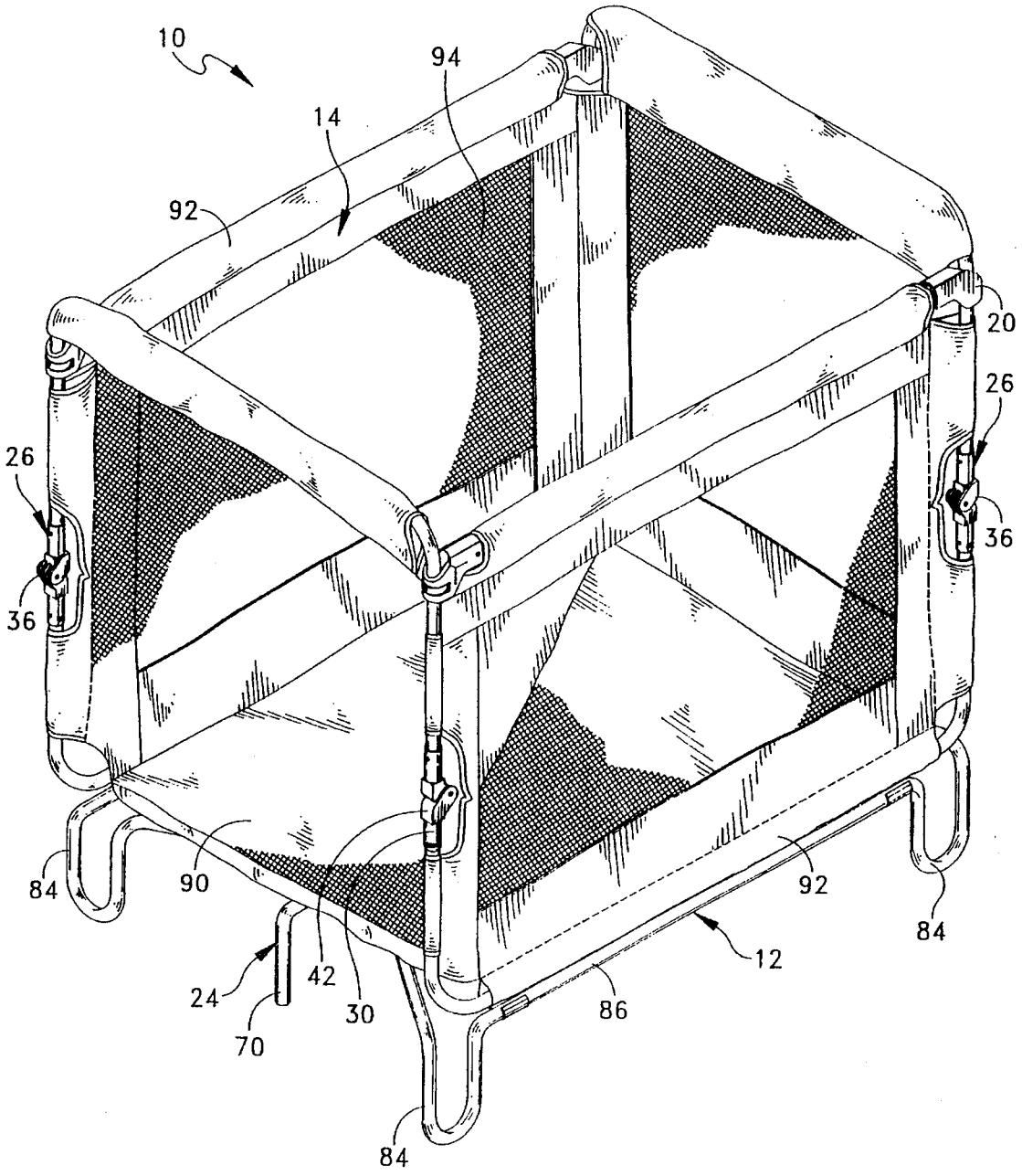
FIG. 1 is a perspective view of the playyard of the instant invention in an erected position.

Referring now to the drawings, the playyard of the instant invention is illustrated in FIGS. 1–16 and generally indicated at 10 in FIGS. 1, 12 and 14–16. The playyard 10 includes a frame assembly generally indicated at 12 and a fabric covering generally indicated at 14 which cooperates with the frame assembly 12 for defining a collapsible playyard assembly which is movable between the erected position illustrated in FIG. 1 and the collapsed position illustrated in FIG. 16. As illustrated in FIG. 1, when the playyard 10 is in the erected position thereof, the frame assembly 12 provides a supporting structure for retaining the covering 14 in a position in which it cooperates with the frame assembly 12 for defining an enclosed playyard structure for receiving and confining an infant therein.

Figure 2:
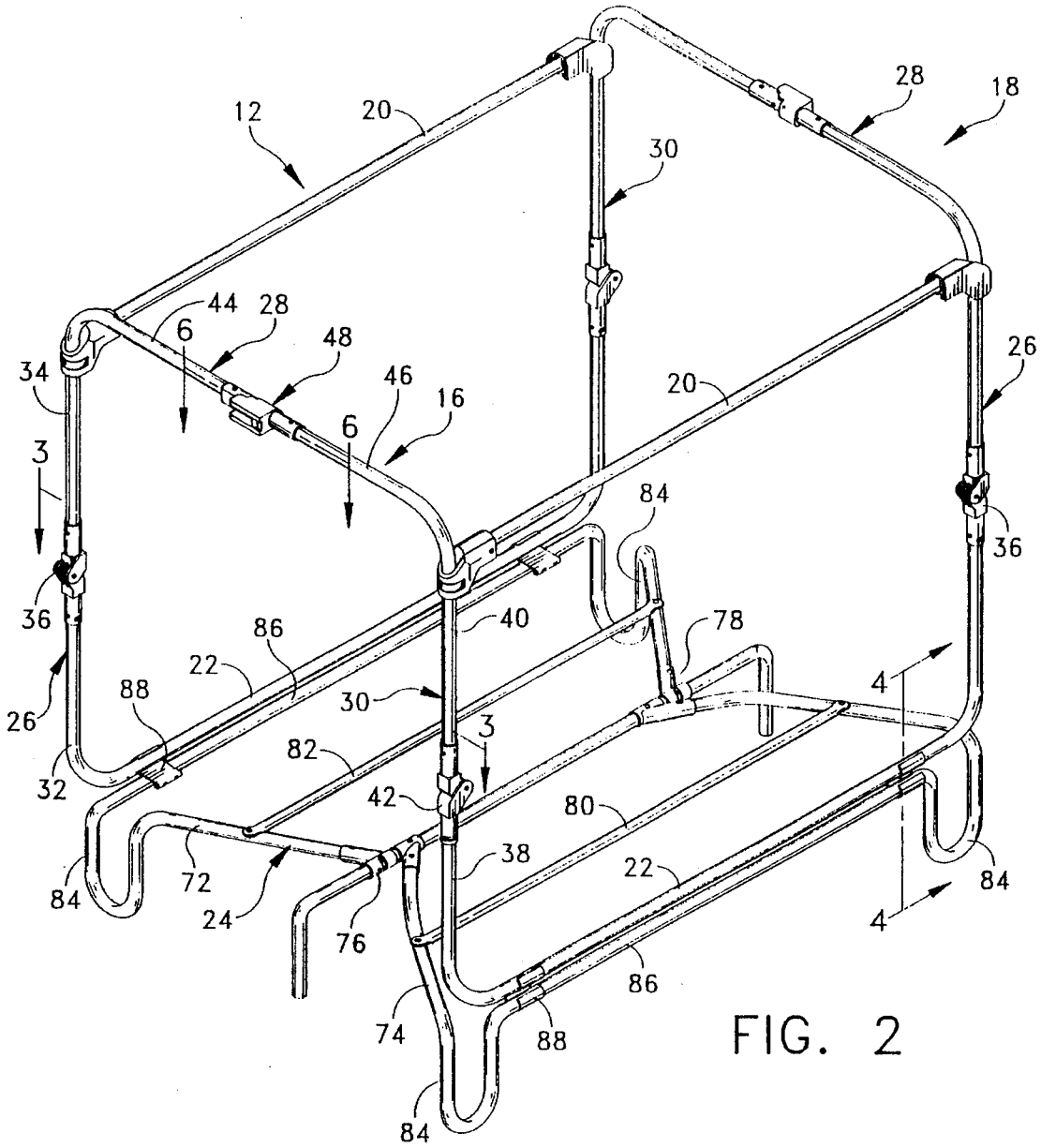
FIG. 2 is a perspective view of the frame assembly thereof in an erected position.
Figure 3:
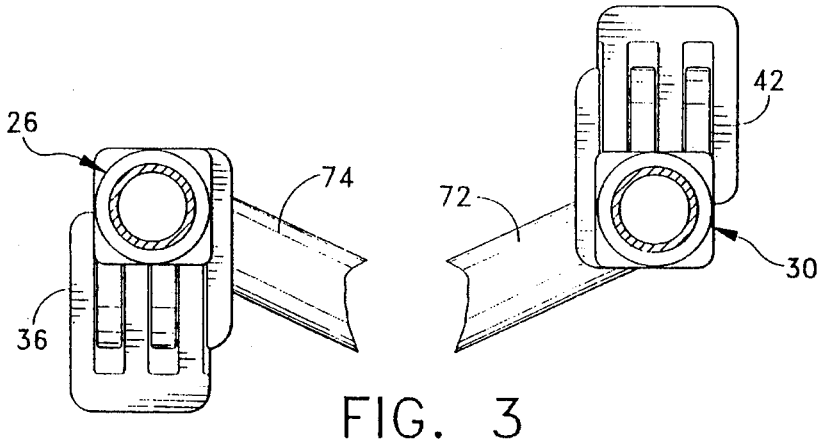
FIG. 3 is a sectional view taken along line 3—3 in FIG. 2.

Referring to FIG. 2, the frame assembly 12 is more clearly illustrated. The frame assembly 12 is adapted so that the various components thereof cooperate to retain the playyard in the erected position thereof in a manner which allows the playyard 10 to be readily and easily moved to the collapsed position thereof which a minimum of manipulations. In this regard, the frame assembly 12 includes first and second end subassemblies 16 and 18 which are connected by upper and lower side frame elements 20 and 22 and a floor assembly generally indicated at 24. The subassemblies 16 and 18 are adapted so that the various components thereof cooperate to maintain the subassemblies 16 and 18 in erected positions, but so that they can be readily moved to collapsed positions with a single unlocking or unlatching manipulation as will hereinafter be more fully set forth.

Figure 10:
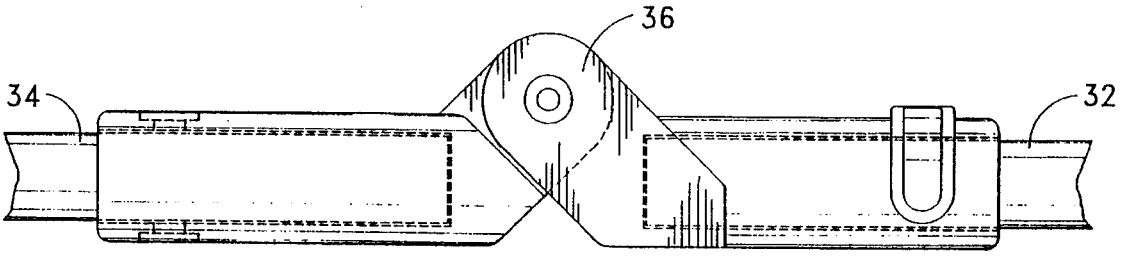
FIG. 10 is a side elevational view of the knuckle assembly of one of the vertical frame members in an erected position.
Figure 11:
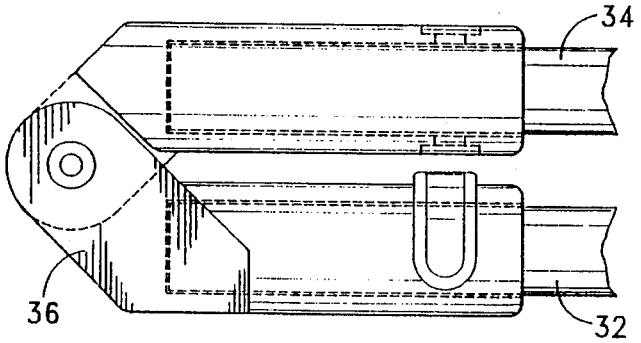
FIG. 11 is a side elevational view thereof in a collapsed position.
Figure 12:
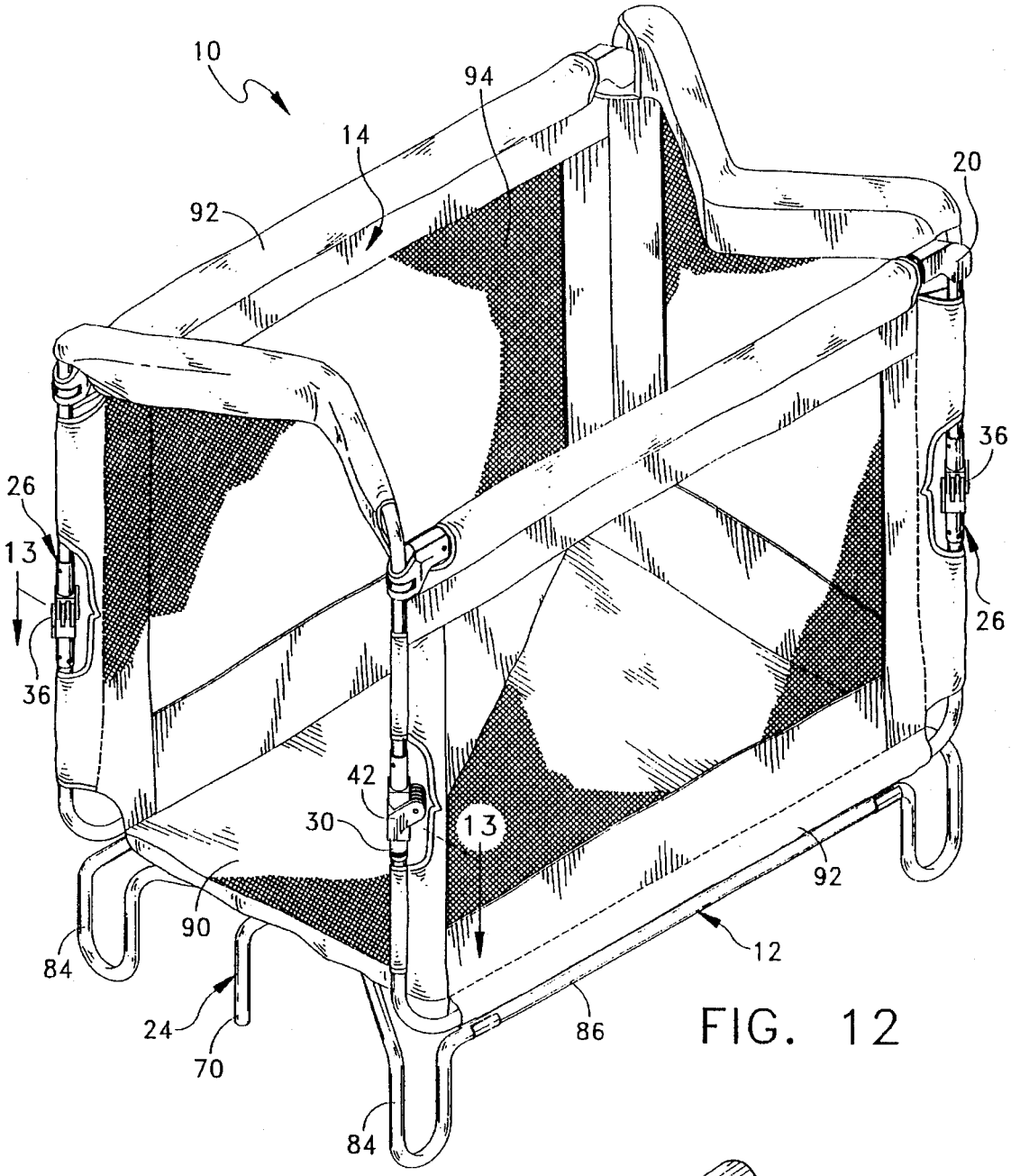
FIG. 12 is a perspective view of the playyard in a partially collapsed position.
Figure 13:
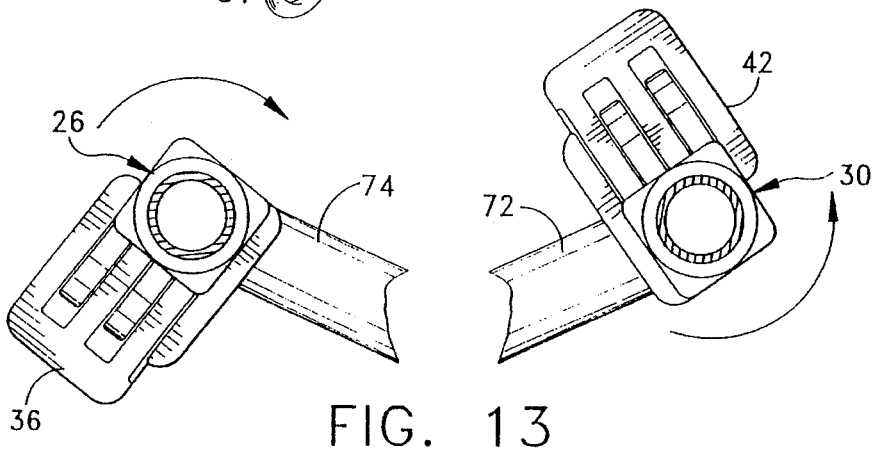
FIG. 13 is a sectional view taken along line 13—13 in FIG. 12.
Figure 14:
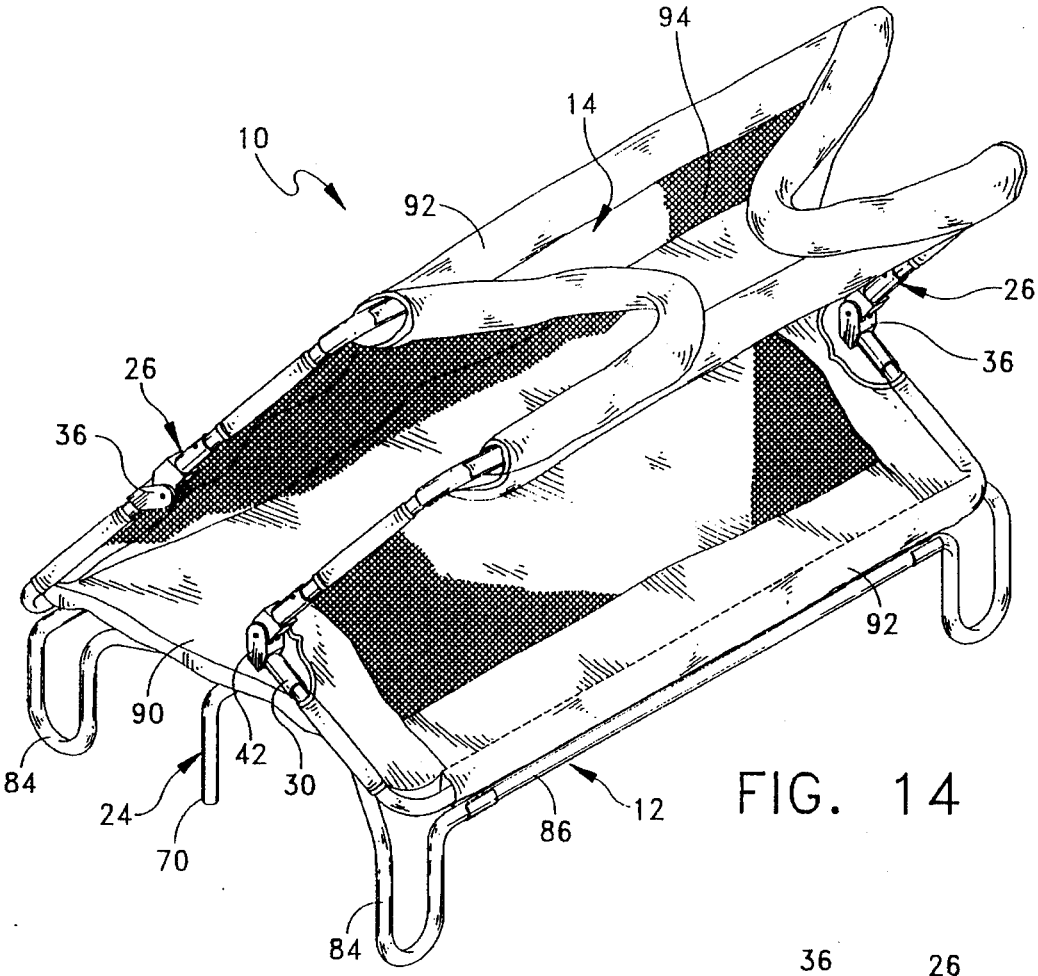
FIGS. 14–16 are sequential perspective views of the playyard as it is moved to a fully collapsed position.
Figure 15:
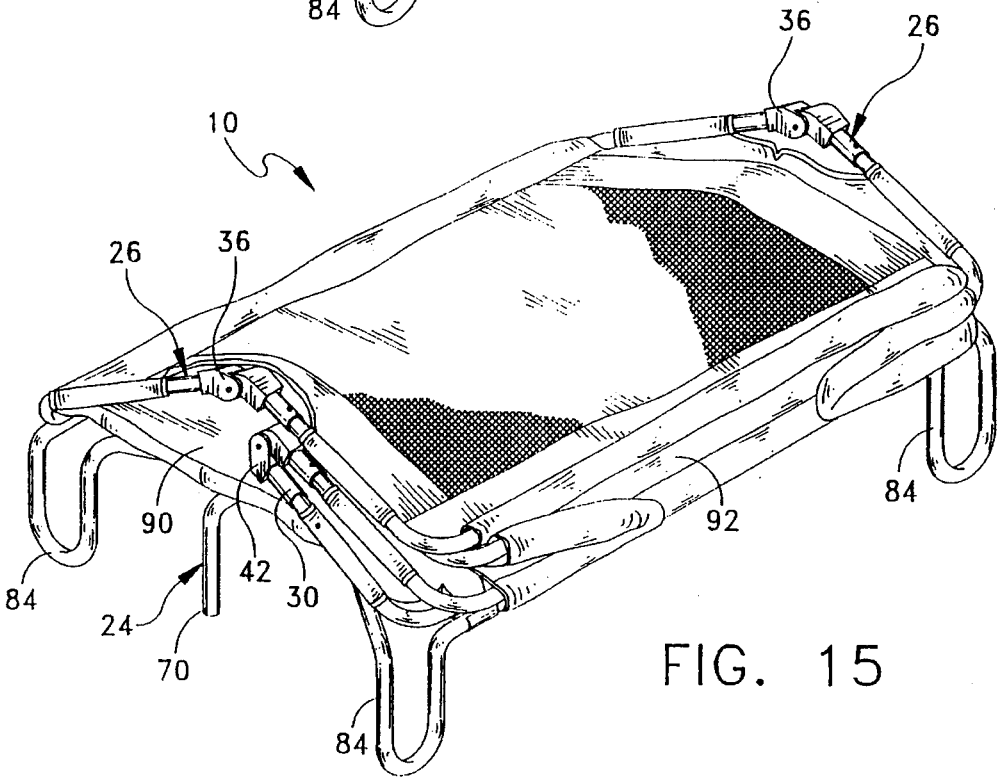

The frame subassemblies 16 and 18 each include first, second and third frame members 26, 28 and 30, respectively. Each of the first frame members 26 includes lower and upper first frame member sections 32 and 34 which are pivotally joined by a knuckle joint 36, and each of the third frame members 30 includes lower and upper frame member sections 38 and 40 which are joined by a knuckle joint 42. Each of the second frame members 28 includes a pair of second frame member sections 44 and 46 which are joined by a knuckle joint 48. The knuckle joints 36 and 42 are of substantially identical configuration and they are rotatably joined to their respective frame member sections 32 and 38 and nonrotatably joined to their respective frame member sections 34 and 40. As illustrated in FIG. 10, the knuckle joints 36 and the correspondingly formed knuckle joints 42 are adapted for connecting the respective frame member sections thereof in substantially aligned relation. However, when the respective frame member sections 32, 34, 38, and 40 of the knuckle joints 36 and 42 are in substantially aligned relation, the knuckle joints 36 and 42 each only permit pivotal movement in a single direction. Further, as illustrated in FIG. 2, the knuckle joints 36 and 42 are constructed and oriented so that when the frame assembly 12 is in the erected position thereof, the knuckle joints 36 and 42 of each subassembly 16 and 18 only permit pivoting between the respective frame member sections thereof in substantially parallel opposite directions. However, as illustrated in FIGS. 12–16, the knuckle joints 36 and 42 are automatically reoriented as the frame members 28 are moved to collapsed positions to enable the frame member sections of the first and third frame members 26 and 30 of each frame subassembly 16 and 18 to be pivoted in substantially the same direction as most clearly illustrated in FIGS. 15 and 16. The frame member sections 44 and 46 of the second frame members 28 are preferably integrally joined in substantially perpendicular relation to the respective adjacent frame member sections 34 and 40 of the respective first and second frame members 26 and 30 thereof. The knuckle joints 48 are also adapted so that when the respective frame member sections 44 and 46 thereof are in substantially aligned relation, they can each only be pivoted in a single direction for moving the second frame members 28 to collapsed positions in which the frame member sections 44 and 46 thereof are in substantially parallel side-by-side relation. The knuckle joints 48 do, however, include locking or latching mechanisms for releasably securing the frame member sections 44 and 46 thereof in substantially aligned relation.

Figure 6:
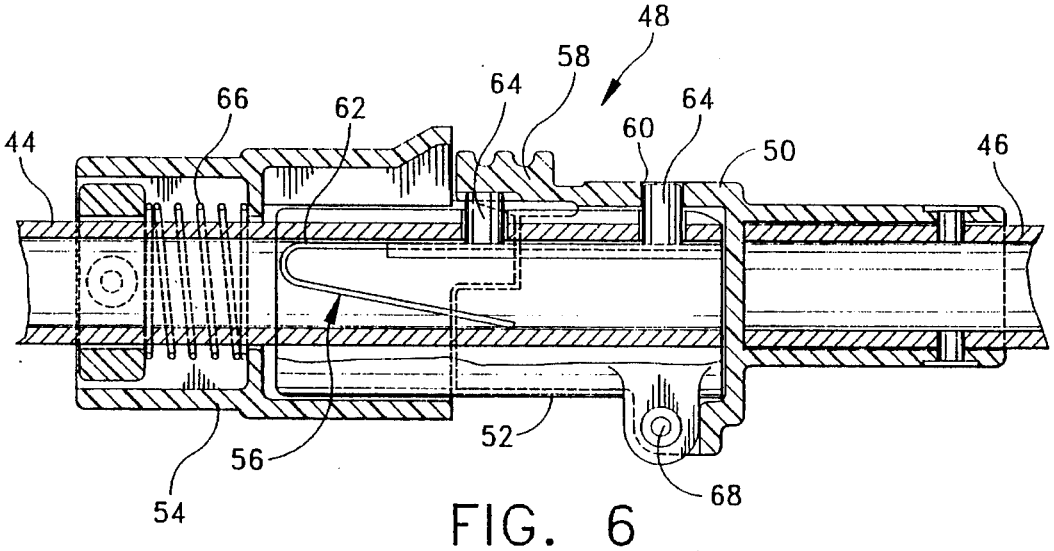
FIG. 6 is a sectional view taken along line 6—6 in FIG. 2.
Figure 7:
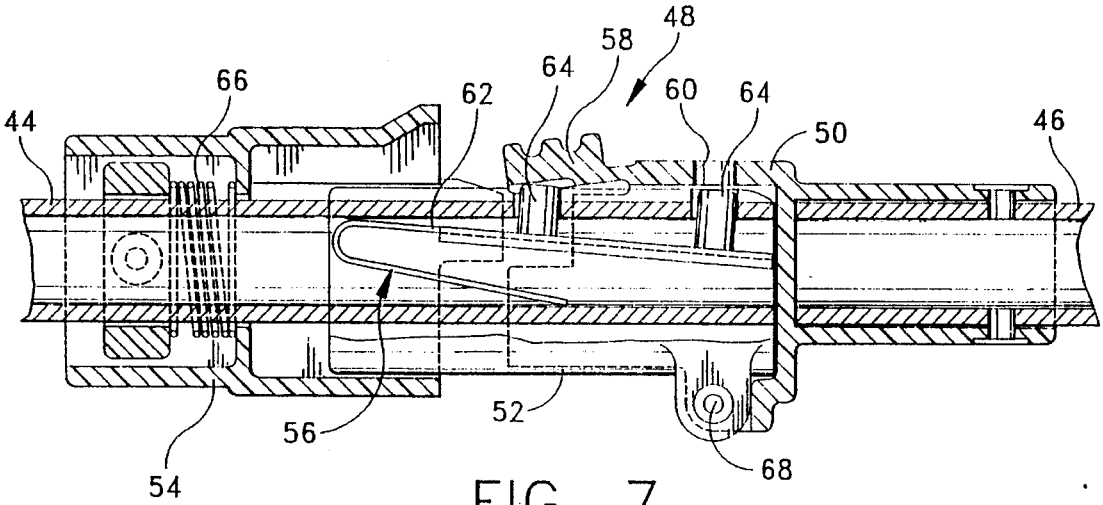
FIG. 7 is a similar view with the latching mechanism in a disengaged position.
Figure 8:
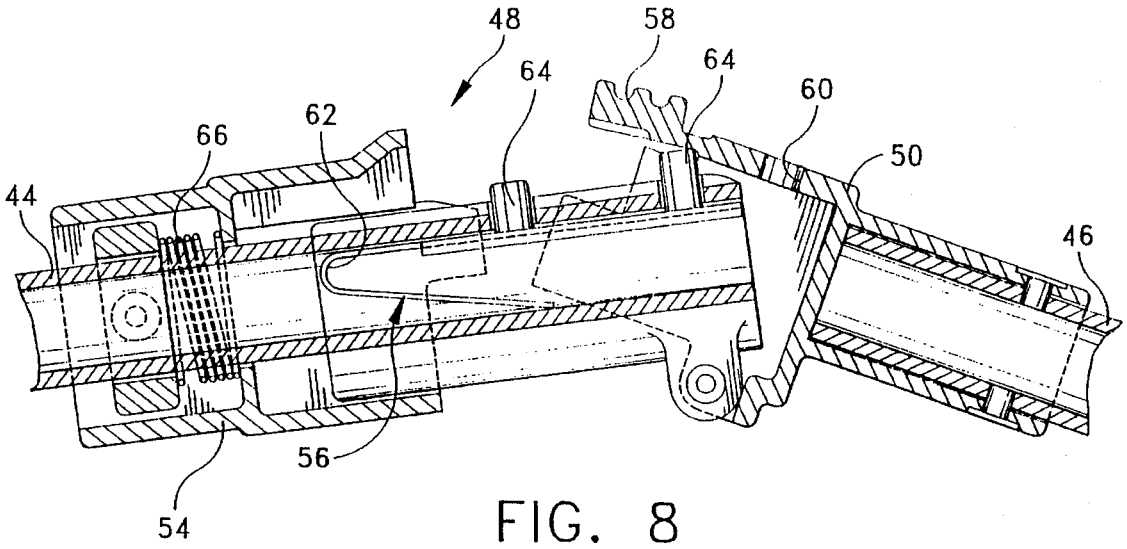
FIG. 8 is a similar sectional view with the knuckle joint in a partially pivoted position.
Figure 9:
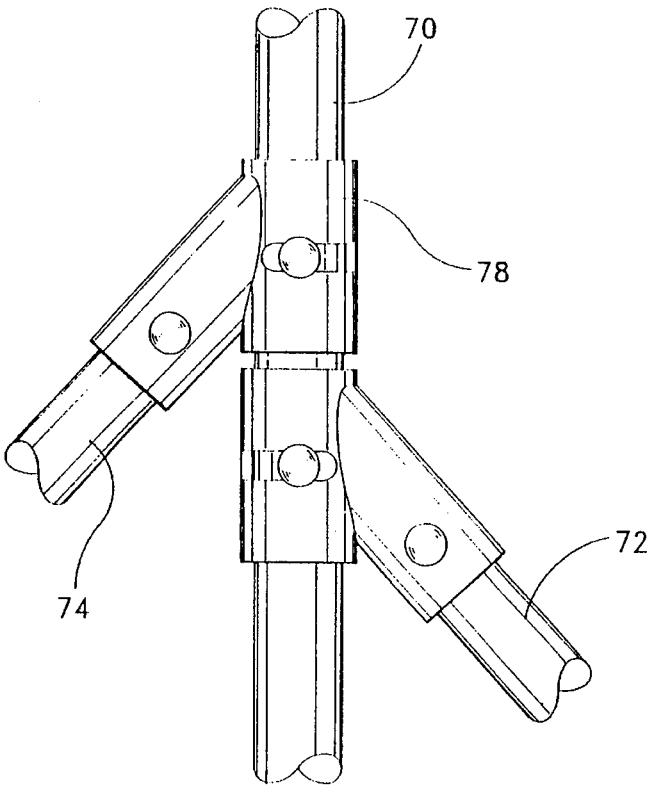
FIG. 9 is a fragmentary top plan view of one end of the center leg section of the bottom frame of the playyard.

As illustrated in FIGS. 6–8, each of the knuckle joints 48 includes a first or outer latch portion 50 which is attached to the respective frame member section 46 thereof, a second or inner latch portion 52 which is attached to the respective frame member section 44 thereof, a sleeve assembly 54, and an inner spring assembly 56. Each of the outer latch member portions 50 includes a resilient latch button section 58 and each has a latch aperture 60 formed therein. Each of the spring assemblies 56 includes a spring element 62 having a pair of latch pins 64 thereon. As illustrated in FIGS. 6–8, when one of the knuckle joint assemblies 48 is in the latched position thereof illustrated in FIG. 6, the button 58 thereof is depressible to move one of the latch pins 64 thereof inwardly so that the other latch pin 64 thereof is withdrawn from the aperture 60 thereof. The sleeve 54 thereof can then be moved against the force of an internal spring 66 to allow the outer first latch portion 50 thereof to be pivoted about a pivot axis 68 relative to the inner latch portion 52 thereof for pivoting the respective frame member sections 44 and 46 thereof.

As illustrated in FIGS. 2, 12 and 14–16, each of the knuckle joint assemblies 48 is oriented so that when the latching components thereof are disengaged, the respective frame member sections 44 and 46 thereof can be pivoted inwardly in a generally horizontal plane. This causes the adjacent frame member sections 34 and 40 and the respective knuckle joints 36 and 42 attached thereto to be rotated by approximately 90 degrees about substantially vertical axes until the knuckle joints 36 and 42 are reoriented to enable the respective frame member sections thereof to be pivoted in substantially the same direction for collapsing the frame 12.

The side frame members 20 are rotatably attached to the subframe assemblies 16 and 18 adjacent the upper ends of the respective first and third frame members 26 and 30 thereof as illustrated most clearly in FIG. 2. On the other hand, the lower side frame members 22 are integrally attached in substantially perpendicular relation to the lower side frame member sections 32 and 38. Accordingly, the upper and lower side frame members 20 and 22 cooperate to maintain the subframe assemblies 16 and 18 in substantially parallel spaced relation while nevertheless permitting the various components thereof to be rotated or pivoted to move the frame assembly 12 to a collapsed position. The upper and lower side frame members 20 and 22 on one side of the playyard 10 are preferably slightly shorter than the upper and lower side frame members 20 and 22 on the opposite side of the playyard 10 so that one side of the playyard 10 is actually slightly shorter than the other side. This allows the first and third frame members 26 and 30 on the shorter side of the playyard 10 to be more effectively nested with the first and third frame members 26 and 30 on the longer side when the playyard 10 is moved to the collapsed position thereof.

Figure 4:
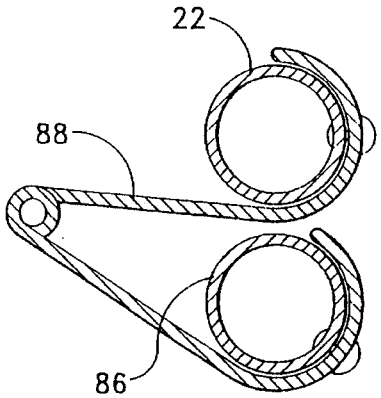
FIG. 4 is a sectional view taken along line 4—4 in FIG. 2.
Figure 5:
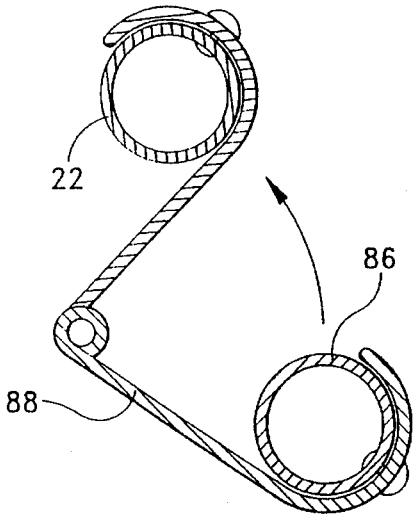
FIG. 5 is a similar view with the playyard in a collapsed position.

The floor assembly 24 comprises a center leg section 70, a pair of side leg sections 72 and 74, a pair of joint assemblies 76 and 78, and a pair of cross members 80 and 82. The center leg section 70 includes an elongated main center portion and a pair of downwardly turned end leg portions as illustrated in FIG. 2. The side leg sections 72 and 74 extend outwardly from the center leg section 70 and they each include a pair of U-shaped foot portions 84 and an elongated side portion 86. The side portions 86 are secured to the side frame members 22 with pivot joint assemblies 88 which are illustrated in FIGS. 4 and 5. The pivot joint assemblies 88 permit the side portions 72 and 74 to be pivoted relative to the side frame members 22 for moving the center leg sections 70 upwardly to a collapsed position as the frame assembly 12 is collapsed in the manner illustrated in FIGS. 14–16. The joint assemblies 76 and 78 secure the side leg sections 72 and 74 to the center leg section 70 in a manner which allows the side leg sections 72 and 74 to be pivoted relative to the center leg sections 70 as the floor assembly 24 is moved to a collapsed position.

The covering 14 comprises a reinforced fabric floor section 90, a plurality of connected tubular fabric sections 92 which are received over various components of the frame assembly 12, and a plurality of fabric mesh wall sections 94 which cooperate with the floor section 90 and the tubular section 92 to define a collapsible fabric covering for the playyard 10. The various fabric sections, including the floor section 90 and the tubular sections 92, are preferably padded to provide protective cushioning for a child received in the playyard 10.

Figure 16:
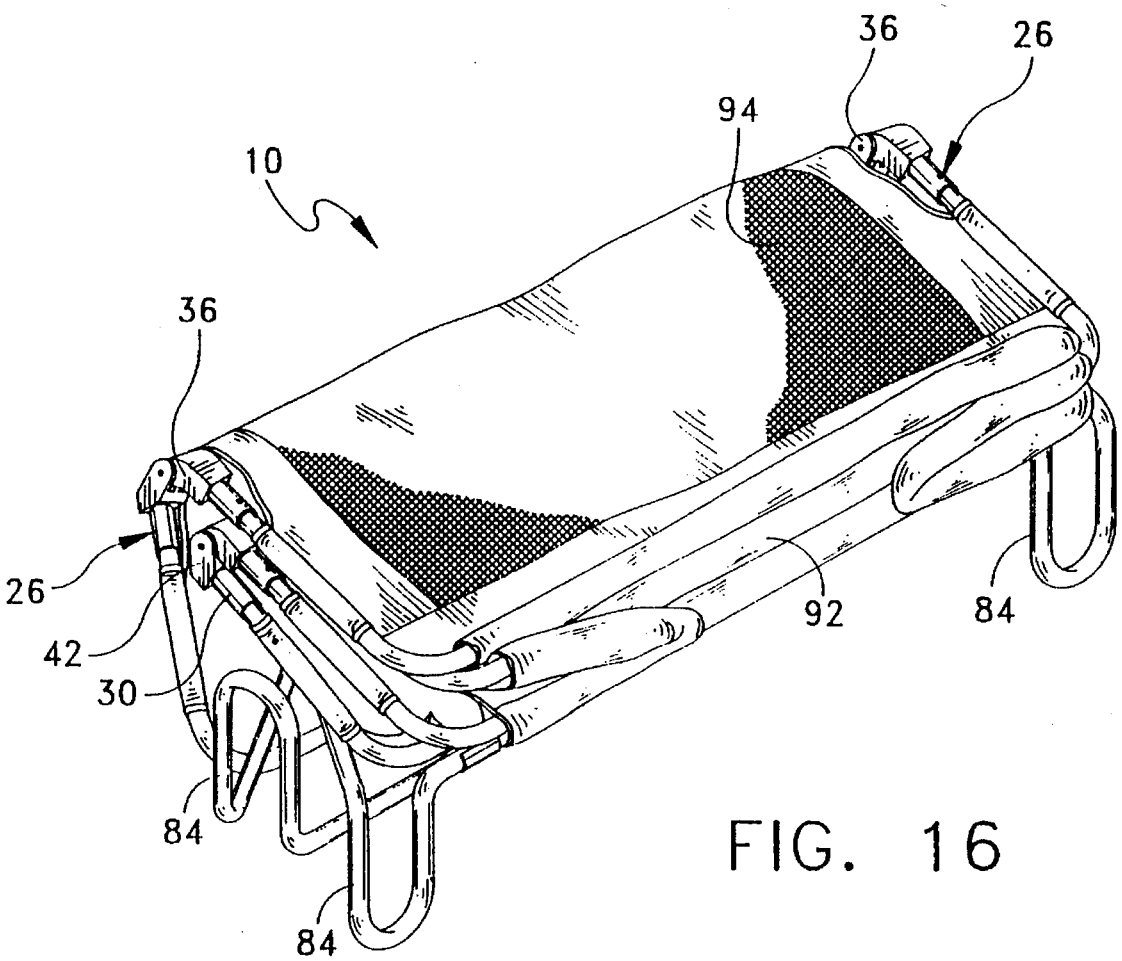

Referring to FIGS. 1, 2, 6–8, 12 and 14–16, it will be seen that the playyard 10 is adapted to be readily and easily moved between the fully erected position illustrated in FIG. 1 and the fully collapsed position illustrated in FIG. 16. In this regard, when the playyard 10 is in the fully erected position thereof, the knuckle joints 48 maintain the second frame member sections 44 and 46 in aligned relation and they also maintain the first and third frame member sections of the subassemblies 16 and 18 in positions where the knuckle joints 36 and 42 thereof are only pivotable in opposite directions. Further, the fabric covering 14 on the frame assembly 12 resists pivoting of either of the knuckle joints 42 or 36 in outward directions. As a result, the relative positions of the knuckle joints 42 and 36 when the said assemblies 16 and 18 are in the erected positions thereof and the fabric covering 14 effectively cooperate to maintain the playyard 10 in an erected position. However, the playyard 10 can be easily moved to a collapsed position simply by disengaging the latching components of the knuckle joints 48 in the manner hereinabove set forth to allow the adjacent frame member sections 44 and 46 of the subassemblies 16 and 18 to be pivoted inwardly and together until the adjacent frame member sections 44 and 46 are received in substantially parallel side-by-side positions. As the knuckle joints 48 are pivoted inwardly in this manner, the center leg section 70 of the floor assembly 24 is moved upwardly to collapse the floor assembly 24 until the first and third frame members 26 and 30 of the subassemblies 16 and 18 are in closely adjacent relation. Further, as the second frame members 28 are collapsed by pivoting the knuckle joints 48 thereof inwardly, the knuckle joints 36 and 42 of each subassembly 16 and 18 are automatically rotated in opposite directions until they are reoriented so that all of the first and third frame members 26 and 30 can be moved to the fully collapsed positions thereof by pivoting the frame member sections 34 and 40 in essentially the same direction towards one side of the playyard 10 as illustrated in FIG. 16. Thereafter, the playyard 10 can be automatically moved to the erected position thereof by simply lifting up on one of the upper side frame members 20 causing the first and third frame member sections 26 and 30 to be moved to erected positions and simultaneously causing the second frame members 28 to be moved to erected positions. As this occurs, the floor assembly 24 is also moved to the fully erected position thereof illustrated in FIG. 2, and, by pushing the knuckle joints 40 outwardly, the playyard 10 can be locked in the fully erected position thereof.

It is seen, therefore, that the instant invention provides a highly effective playyard. The playyard 10 can be moved to a collapsed position simply by manipulating the knuckle joints 48 to disengage the latching assemblies contained therein and then folding the various components of the playyard inwardly and downwardly. As a result, the playyard 10 can be collapsed to the position illustrated in FIG. 16 within a relatively few seconds. The playyard 10 can also be erected within a matter of a few seconds with a simple and easy lifting movement of one of the side frame members 20. Further, it will be understood that the basic concept of providing a playyard having a subframe assembly which is constructed so that collapsing one frame member reorients another adjacent frame member can also be embodied in a variety of other playyard constructions, such as one in which collapsing a vertical frame member automatically reorients an adjacent horizontal frame member to a collapsible position. Hence, it is seen that the playyard 10 represents a significant advancement in the art which has substantial commercial merit.

While there is shown an described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A collapsible frame subassembly for a playyard for an infant comprising first, second and third frame members, said second frame member extending between said first and third frame members, said subassembly being positionable in an erected position in which said first and third frame members are in spaced substantially parallel coplanar relation and cooperate with said second frame member to define a generally square-cornered U-shaped structure, said frame members each including a pair of frame member sections which are pivotally joined by a knuckle joint, the respective frame member sections of said frame members being substantially aligned when said subassembly is in the erected position thereof, the knuckle joints of said frame members each only permitting relative pivotal movement from aligned relation between the respective frame member sections thereof in a single direction when said assembly is in the erected position thereof, the knuckle joints of said first and third frame members only permitting pivoting from aligned relation between the respective frame member sections thereof in directions which are angularly oriented at an angle of at least 90 degrees when said subassembly is in the erected position thereof, said second frame member being connected to said first and third frame members such that relative pivoting between said second frame member sections to substantially parallel side-by-side positions causes sufficient axial rotation of the knuckle joint of at least one of said first and third frame members to permit relative pivoting between the frame member sections of said first and third frame members in substantially the same direction for collapsing said subassembly.

2. The collapsible frame subassembly of claim 1 further comprising means for releasably maintaining said second frame member in the erected position thereof.

3. In the collapsible frame subassembly of claim 2, wherein said first and third frame members are retained in the erected positions thereof by relative positions of the respective knuckle joints thereof when said subassembly is in the erected position thereof.

4. The collapsible frame subassembly of claim 1, wherein the knuckle joints of said first and third frame members only permit pivoting between the respective frame member sections thereof in opposite substantially parallel directions when said subassembly is in the erected position thereof, said second frame member being connected to said first and third frame members such that relative pivoting between said second frame member sections to substantially parallel side-by-side positions causes sufficient axial rotation of the knuckle joints of said first and third frame members to permit relative pivoting between the frame member sections of said first and third frame members in substantially the same direction for collapsing said subassembly.

5. A collapsible playyard for an infant comprising collapsible frame means and covering means on said frame means cooperating therewith for defining an enclosed playyard structure for receiving and confining said infant, said frame means comprising a subassembly including first and third frame members and a second frame member extending therebetween, said subassembly being positionable in an erected position in which said first and third frame members are in spaced substantially parallel coplanar relation and cooperate to define a generally square-cornered, U-shaped structure, said covering means being received on said U-shaped structure and cooperating therewith to define a wall of said playyard, said frame members each including a pair of frame member sections which are pivotally joined by a knuckle joint, the respective frame member sections of said frame members being substantially aligned when said subassembly is in the erected position thereof, the knuckle joints of said frame members each only permitting relative pivotal movement between the respective frame member sections thereof in a single direction when said subassembly is in the erected position thereof, the knuckle joints of said first and third frame members only permitting pivoting between the respective frame member sections thereof in directions which are at least 90 degrees apart when said subassembly is in the erected position thereof, said second frame member being connected to said first and third frame members such that relative pivoting between said second frame member sections to substantially parallel side-by-side positions causes sufficient axial rotation of the knuckle joint of at least one of said first and third frame members to permit relative pivoting of the frame member sections of said first and third frame members in substantially the same direction for collapsing said wall.

6. The collapsible playyard of claim 5, wherein said frame means further comprising a pair of said subassemblies positioned in spaced substantially parallel relation and cooperating with said covering means to define a pair of spaced substantially parallel walls of said playyard when said subassemblies are in the erected positions thereof.

7. The collapsible playyard of claim 6, wherein the second frame member sections of the second frame members of said subassemblies are pivotable for moving the knuckle joints thereof inwardly and together for collapsing said frame means.

8. The collapsible playyard of claim 5, wherein the knuckle joints of said first and third frame members only permit pivoting between the respective frame member sections thereof in opposite substantially parallel directions when said subassembly is in the erected position thereof, said second frame member being connected to said first and third frame members such that relative pivoting between said second frame member sections to substantially parallel side-by-side positions causes sufficient axial rotation of the knuckle joints of said first and third frame members to permit relative pivoting between the frame member sections of said first and third frame members in substantially the same direction for collapsing said subassembly.

9. The collapsible playyard of claim 5, wherein the knuckle joint of at least one of said first and third frame members is oriented such that said covering means prevents pivoting of said at least one frame member in the respective single direction thereof when said subassembly is in the erected position thereof but not when the knuckle joint in said second frame member has been pivoted so the said second frame member sections are in substantially parallel side-by-side positions.

10. A collapsible frame subassembly for a playyard for an infant comprising a first frame member and a second frame member connected to said first frame member in substantially perpendicular relation thereto, said first and second frame members each including a pair of frame member sections which are joined by a knuckle joint, the knuckle joints of said frame members each only permitting relative pivotal movement from an aligned position between the respective frame member sections thereof in a single direction, the directions of pivotal movement permitted by the knuckle joints of said first and second frame members being angularly oriented at an angle of at least 90 degrees when said subassembly is in an erected position thereof, said second frame member being attached to said first frame member such that relative pivoting between said second frame member sections to substantially side-by-side positions causes the knuckle joint of said first frame member to be axially rotated by approximately 90 degrees to permit said first frame member to be collapsed in a corresponding predetermined direction.

* * * * *